US009833377B2

(12) United States Patent
Smed

(10) Patent No.: US 9,833,377 B2
(45) Date of Patent: Dec. 5, 2017

(54) WALKER

(71) Applicant: Ole F. Smed, Calgary (CA)

(72) Inventor: Ole F. Smed, Calgary (CA)

( * ) Notice: Subject to any disclaimer, the term of this patent is extended or adjusted under 35 U.S.C. 154(b) by 0 days.

(21) Appl. No.: 15/415,682

(22) Filed: Jan. 25, 2017

(65) Prior Publication Data

US 2017/0151121 A1 Jun. 1, 2017

Related U.S. Application Data

(63) Continuation-in-part of application No. 14/955,460, filed on Dec. 1, 2015, now abandoned.

(51) Int. Cl.
*A61H 3/04* (2006.01)

(52) U.S. Cl.
CPC ..... *A61H 3/04* (2013.01); *A61H 2201/0192* (2013.01); *A61H 2201/1635* (2013.01)

(58) Field of Classification Search
CPC .... A45B 2201/0192; A61H 2201/1635; A61H 2201/1614; A61H 3/00; A61H 3/02; A61H 3/04; Y10T 403/32254; Y10T 403/32262; Y10T 403/32426; Y10T 403/32532; Y10T 403/32541
USPC ..... 135/67; 482/67; 403/111, 119, 408.1
See application file for complete search history.

(56) References Cited

U.S. PATENT DOCUMENTS 1,917,440 A * 7/1933 Finkbeiner ..... A61H 3/00 135/67
2,459,066 A * 1/1949 Duke ..... A61H 3/04 297/215.13
2,634,790 A * 4/1953 Elle ..... A61H 3/00 135/67
2,796,916 A * 6/1957 Womble ..... A61H 3/00 135/67
3,195,550 A * 7/1965 Ingalls ..... A61H 3/04 135/67
4,187,869 A * 2/1980 Marchetti ..... A61H 3/04 135/67
4,226,413 A * 10/1980 Daugherty ..... A61H 3/04 188/1.12
4,547,092 A * 10/1985 Vetter ..... A61G 7/0503 248/229.11
4,993,446 A * 2/1991 Yarbrough ..... A61H 3/00 135/67
5,520,474 A * 5/1996 Liu ..... F16B 7/04 403/103
5,564,852 A * 10/1996 Maxwell ..... F16C 11/10 403/171

(Continued)

*Primary Examiner* — Noah Chandler Hawk
(74) *Attorney, Agent, or Firm* — Carl A. Hjort, III

(57) ABSTRACT

Embodiments of a walker are shown, the walker including two patient-load bearing support tubes each having a padded underarm support for seating in the armpit of a patient, an adjustable-height load bearing tube and a rubber tip. Connected to each of the patient-load bearing tubes are two L-shaped legs with a wheel disposed at the end of the leg and a grip disposed on the leg for a patient to grip when the walker is in use. A main tube is connected between the two legs and defines the width of the walker. The height of the patient-load bearing tubes may be adjusted from an extended position in which the padded underarm support is seated in the armpit of the patient to a retracted position in which the padded underarm support does not interfere with the patient's use of the walker.

12 Claims, 4 Drawing Sheets

(56) References Cited

U.S. PATENT DOCUMENTS

| | | | | |
|---|---|---|---|---|
| 7,677,259 | B1 * | 3/2010 | Arbuckle | A61H 3/04 135/66 |
| 8,235,760 | B2 * | 8/2012 | Rechner | B63H 16/04 440/101 |
| 2013/0319488 | A1 * | 12/2013 | Chiu | A61H 3/00 135/67 |

* cited by examiner

WALKER

CROSS-REFERENCE TO RELATED APPLICATIONS

This application is a continuation-in-part of U.S. patent application Ser. No. 14/955,460, filed Dec. 1, 2015, now abandoned.

DETAILED DESCRIPTION OF THE DRAWINGS

Embodiments of a walker are shown and described. Generally, the walker comprises two patient-load bearing support tubes, each patient-load bearing support tube comprising a padded underarm support for seating in the armpit of a patient, an adjustable-height load bearing tube, having a first end and a second end, wherein the first end of the adjustable-height load bearing tube is connected to the padded underarm support and the second end of the adjustable-height load bearing tube is provided with a rubber tip; two L-shaped legs, each leg connected at a first end to one of the patient-load bearing support tubes, wherein each leg has a wheel disposed at the second end, and a grip disposed on the leg for a patient to grip when the walker is in use; and a main tube connected between the two legs and defining the width of the walker; wherein the height of the patient-load bearing tubes may be adjusted from an extended position in which the padded underarm support is seated in the armpit of the patient to a retracted position in which the padded underarm support does not interfere with the patient's use of the walker.

Figure 1:
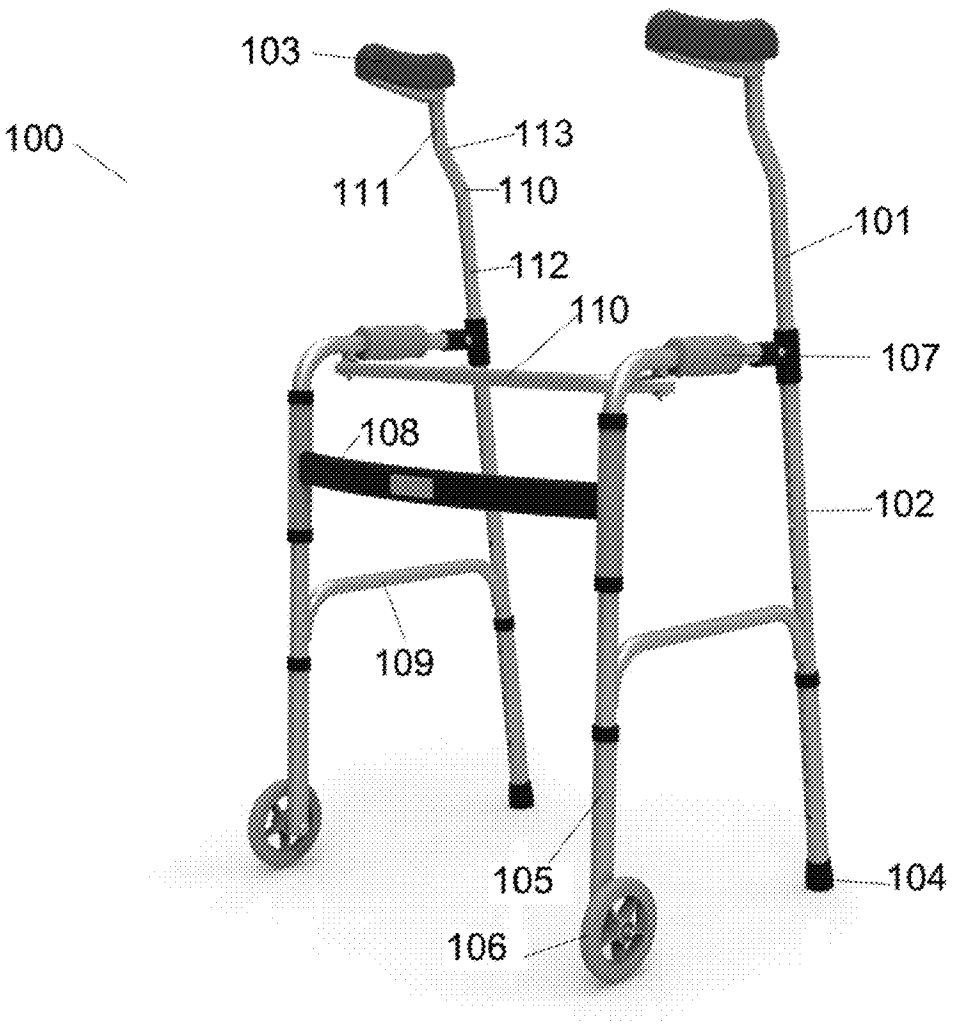
FIG. 1 is a perspective view of an embodiment of the walker.

FIG. 1 shows a perspective view of an embodiment of the walker 100. As can be seen in FIG. 1, the walker 100 is provided with a patient-load bearing support tube 101. The patient load-bearing support tube 101 is made up of an adjustable-height load bearing tube 102, a padded underarm support 103 and a rubber tip 104. The adjustable-height load bearing tube 102 allows for the adjustment of the height of the padded underarm support 103, so that the padded underarm support 103 may be seated in the armpit of a patient. The adjustable-height load bearing tube 102 may take the form of two concentric tubes, one being a fixed bottom portion and the other being an extendible portion extending out of the fixed bottom portion. As can best be seen in FIG. 4 which is a close-up view of the adjustable height load bearing tube 102, the position of the adjustable-height load bearing tube 102 may be adjustable by means of a spring loaded pin 402 extending through the extendible portion and engaged a the hole 401 in the fixed bottom portion. As can be seen in FIG. 4, a plurality of holes 401 are provided to allow for different heights to be selected by the user. Alternatively, the height of the adjustable-height load bearing tube 102 may adjusted by a friction fit, i.e. fastening between two parts which is achieved by friction after the parts are pushed together, rather than by any other means of fastening, between the two concentric tubes. Other mechanisms for adjusting the height of the tube are known in the art and within the scope of the invention. The padded underarm support 103 may be made of foam, plastic or other materials known in the art, and may be covered by cloth, fabric, leather or other upholstery materials as needed in any particular application. It should be appreciated by one of ordinary skill in the art that the hardness or softness of the padded underarm support 103 can be varied to meet, for example, the needs of a particular patient. The rubber tip 104, aids the use of the walker by providing a non-skid surface when the end of the patient-load bearing support tube is in contact with a walking surface. Joint 110 allows a ratcheting hinge to be disposed inside the patient load bearing support tube 101, so that the angle of padded underarm support 103 may be adjusted. The mechanism of the ratcheting hinge will be discussed in greater detail in connection with the discussion of FIGS. 3*a* and 3*b*.

Also provided in the walker 100 are legs 105. As can been seen in FIG. 1, one end of the legs 105 are connected to the patient-load bearing support tube 101. Disposed at an opposite end of the legs 105 is the wheel 106. Wheel 106 also aids in the use of the walker by allowing the walker frame to glide smoothly on the walking surface when the patient pushes the walker forward. The length of the legs 105 may be adjustable, to accommodate patients of differing heights. Such adjustments may be accomplished by the means disclosed above in connection with adjustability of the adjustable-height load bearing tube 102 or other means for adjustment known in the art. The legs 105 are provided with a grip 107, which the patient grips during use of the walker. One of ordinary skill in the art will appreciate that the grip 107 may again be made of foam, plastic or other materials known in the art, and may optionally be covered by cloth, fabric, leather or other upholstery materials as needed in any particular application. Optionally, intermediate leg supports 109 can be provided to further stabilize the legs and increase their weight bearing capacity.

The width of the walker 100 is defined by the main tube 108. As can be seen in FIG. 1, the main tube 108 is connected between the two legs 105. The main tube is rigidly connected to the two legs 105, and may be connected by any means known in the art, for example by welding, rivets, screws or by making the legs 105 and the main tube 108 from a single contiguous piece of material. Optionally, an additional support member 110 can be connected between the legs 105 to provide additional support for the main tube 108, and further stabilizing the connection between the legs 105.

Figure 2C:
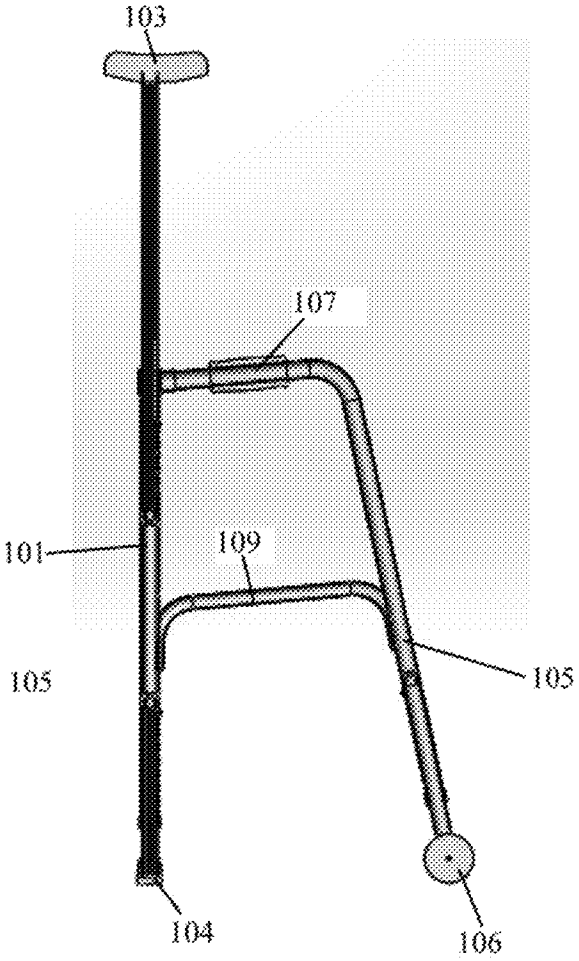
FIGS. 2*a*, 2*b* and 2*c* are side views of an embodiment of the walker showing the height adjustability of the walker.
Figure 2B:
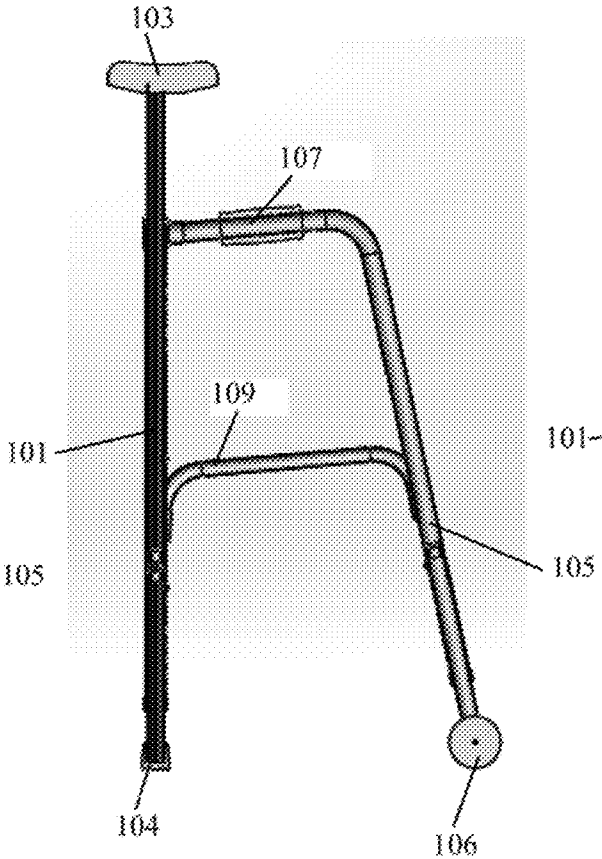
Figure 2A:
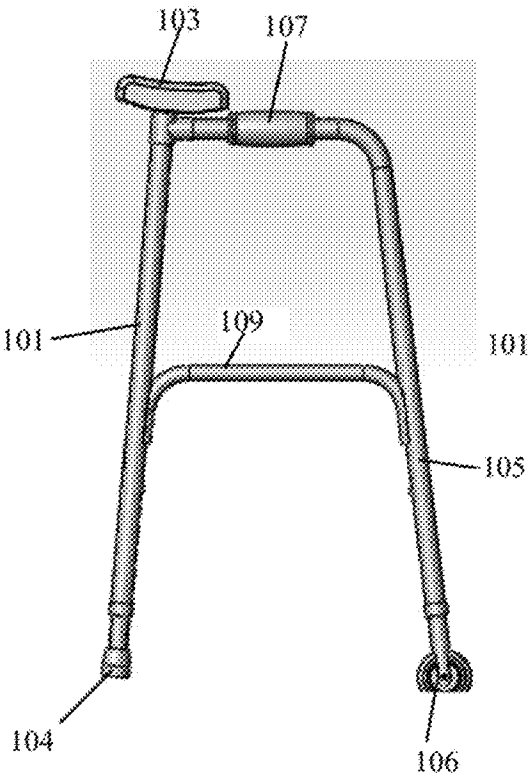

FIGS. 2*a*, 2*b* and 2*c* show the height adjustability of the walker 100. Like numerals will be used to point out features in FIGS. 2*a-c* as were used in the description of those features in the description of FIG. 1. Thus, in FIG. 2*a-c*, the walker 100 is provided with the patient-load bearing support tube 101, the padded underarm support 103 and the rubber tip 104. Also provided in the walker 100 are legs 105 with the wheel 106 and the grip 107 and intermediate leg supports 109. As can be seen in FIG. 2*a*, the patient-load bearing support tube 101 is in a retracted position. In this position, the padded underarm support 103 does not interfere with the patient's use of the walker. In FIG. 2*b*, the patient-load bearing support tube is shown in an intermediate position. In this position, the padded underarm support 103 may be seated in the armpit of a patient of shorter stature. Alternatively, a patient may rest his or her arms on the padded underarm support 103, without seating the padded underarm support in his or her armpit. Finally, in FIG. 2*c*, the patient-load bearing support tube is shown in a fully extended position. In this position, the padded underarm support 103 will be seated in the armpit of the patient. In this way, the patient can take advantage of the support provided by the patient-load bearing support tube while also using the walker to assist in their mobility.

Figure 3B:
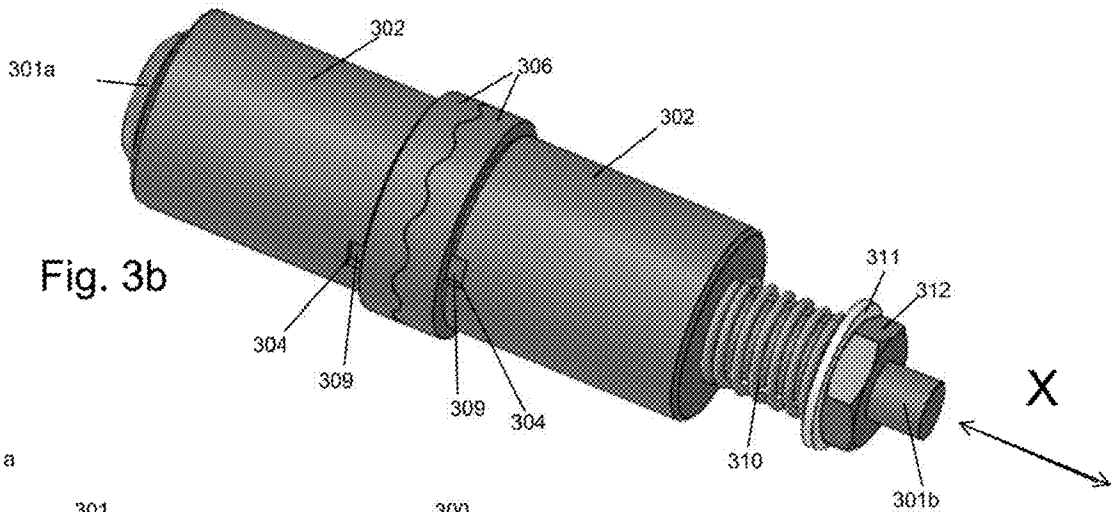
FIGS. 3*a* and 3*b* are a partially exploded and assembled view, respectively, of a ratcheting hinge assembly used in an embodiment of the walker.
Figure 3A:
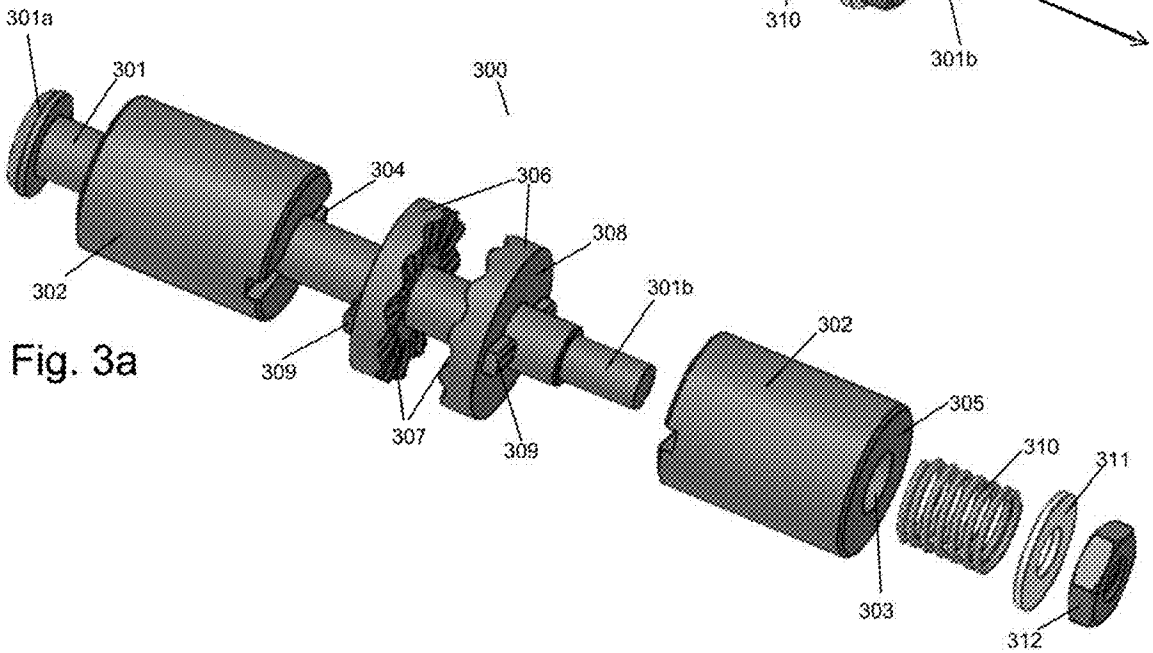
Figure 4:
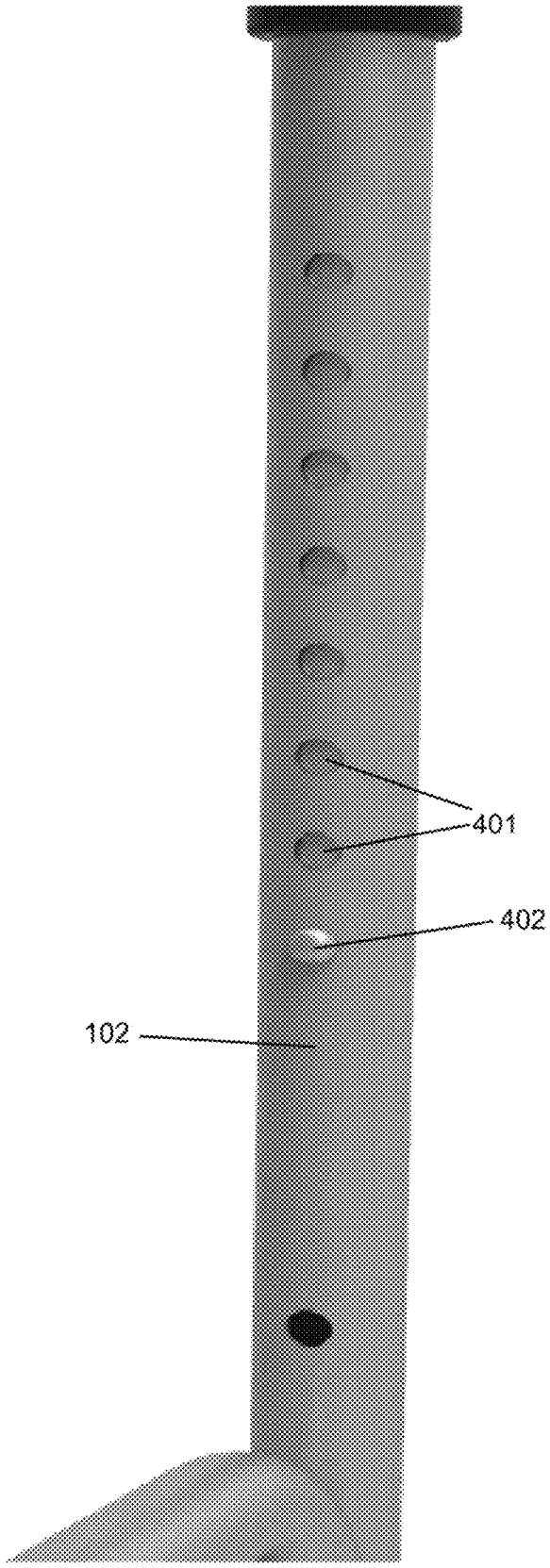
FIG. 4 is a close-up view of the height-adjustable load bearing tube, showing the mechanism of height adjustment.

FIGS. 3*a* and 3*b* show a partially exploded view and an assembled view of the ratcheting hinge assembly used in embodiments of the walker. As can be seen best in the partially exploded view of FIG. 3*a*, the ratcheting hinge assembly 300 has a shaft 301 having a first spacer-retaining end 301*a* and a second threaded end 301*b*. Also included in the ratcheting hinge assembly are first and second cylindrical spacers 302. Each of the cylindrical spacers 302 having an axial bore 303 therethrough and a first end having a groove 304 disposed thereon and a second non-grooved end 305.

A pair of mating gears 306 are also provided in the ratcheting hinge assembly. Each of the mating gears 306 has an axial bore therethrough such that they can be disposed on the shaft 301. Each of the mating gears 306 has a first gear surface 307 and an opposing second rear surface 308. As can be best seen in the assembled view of FIG. 4, the first gear surface 307 of one of the mating gears 306 engages with the first gear surface 307 of the opposing mating gear 306. The second rear surface 308 of each of the mating gears 306 has a key 309 disposed thereon.

With reference again to the assembled view of FIG. 3*b*, the shaft 301 passes through the axial bores 303 of the first and second cylindrical spacers 302 and the pair of mating gears 306. The first cylindrical spacer 302 is in contact with the spacer-retaining end 301*a* of the shaft 301 and the keys 309 on the second rear surface 308 of each mating gear 306 are aligned and engaged with the grooves 304 disposed on the first end of each of the first and second cylindrical spacers 302. A spring 310 is disposed on the shaft 301 and mating with the second non-grooved end 305 of the second cylindrical spacer 302. A washer 311 is also disposed on the shaft and in contact with the spring 310 and a nut 312 is engaged with the second threaded end 301*b* of the shaft 301. Tightening the nut 312 on the second threaded end 301*b* of the shaft 301 compresses the spring 310 and thereby compresses together the first and second cylindrical spacers 302 and the pair of mating gears 306. The ratcheting hinge 300 allows for rotation in the direction R marked in FIG. 3*b*, but the rotation is constrained to discrete ratcheting steps by the interaction of the opposing gear surfaces 307.

When assembled in the walker, the ratcheting hinge 300 is disposed inside the patient load bearing support tube 101. A joint 110 is provided in the patient load bearing support tube 101 which allows a first one of the spacer 302 and associated gear 306 to be inserted in an upper portion 111 of the patient load bearing support tube 101 and the second spacer 302 and associated gear 306 to be inserted in a lower portion 112 of the patient load bearing support tube 101. The interface of the gear surfaces 307 is at the joint 110, such that the upper portion 111 may be rotated relative to the lower portion 112. Optionally, an additional joint 113 may be provided in the patient load bearing support tube 101, to accommodate a second ratcheting hinge 300. The inclusion of this additional joint 113 allows for further articulation of the padded under arm support 103.

It will be appreciated by those of ordinary skill in the art that, while the forgoing disclosure has been set forth in connection with particular embodiments and examples, the disclosure is not intended to be necessarily so limited, and that numerous other embodiments, examples, uses, modifications and departures from the embodiments, examples and uses described herein are intended to be encompassed by the claims attached hereto. Various features of the disclosure are set forth in the following claims.

I claim:

1. A walker comprising:

two patient-load bearing support tubes, each patient-load bearing support tube comprising a padded underarm support for seating in the armpit of a patient, an adjustable-height load bearing tube, having a first end and a second end, wherein the second end of the adjustable-height load bearing tube is provided with a rubber tip and the first end of the adjustable-height load bearing tube is connected to the padded underarm support, wherein the adjustable-height load bearing tube includes at least one joint;

two L-shaped legs, each leg connected at a first end to one of the patient-load bearing support tubes, wherein each leg has a wheel disposed at a second end, and a grip disposed on the leg for a patient to grip when the walker is in use;

a main tube connected between the two legs and defining the width of the walker;

wherein the height of the patient-load bearing tubes may be adjusted from an extended position in which the padded underarm support is seated in the armpit of the patient to a retracted position in which the padded underarm support does not interfere with the patient's use of the walker; and wherein the walker further comprises a ratcheting hinge at the at least one joint in the adjustable-height load bearing tube, said ratcheting hinge comprising:

a shaft having a first spacer-retaining end and a second threaded end;

first and second cylindrical spacers, each of the cylindrical spacers having an axial bore therethrough and a first end having a groove disposed thereon and a second non-grooved end;

a pair of mating gears, each of the mating gears having an axial bore therethrough and a first gear surface and an opposing second rear surface, wherein the first gear surface of one of the mating gears engages with the first gear surface of the opposing mating gear, and wherein the second rear surface of each of the mating gears has a key disposed thereon;

wherein the shaft passes through the axial bores of the first and second cylindrical spacers and the pair of mating gears and wherein the first cylindrical spacer is in contact with the spacer-retaining end of the shaft and the keys on the second rear surface of each mating gear are aligned and engaged with the grooves disposed on the first end of each of the first and second cylindrical spacers; and a spring disposed on the shaft and mating with the second non-grooved end of the second cylindrical spacer;

a washer disposed on the shaft and in contact with the spring and a nut engaged with the second threaded end of the shaft;

wherein tightening the nut on the second threaded end of the shaft compresses the spring and thereby compresses together the first and second cylindrical spacers and the pair of mating gears; and wherein the rotation of the ratcheting hinge is constrained to discrete ratcheting steps by the interaction of the opposing gear surfaces.

2. The walker of claim 1 further comprising two intermediate leg supports, each of the leg supports connected between the legs and the patient-load bearing support tubes.

3. The walker of claim 1 further comprising at least one additional support member disposed between the leg members to provide additional support for the main tube.

4. The walker of claim 1, wherein the length of the legs is adjustable.

5. The walker of claim 1, wherein the height of the adjustable-height load bearing tube is adjusted by a spring loaded pin extending through an extendible portion and engaged with a hole in a fixed bottom portion.

6. The walker of claim 1, wherein the height of the adjustable-height load bearing tube is adjusted by a friction fit between two portions of the adjustable-height load bearing tube.

7. The walker of claim 1, wherein the padded underarm support is comprised of foam or plastic.

8. The walker of claim 7, wherein the padded underarm support is covered by cloth, fabric, leather or other upholstery materials.

9. The walker of claim 1, wherein the hardness of the padded underarm support is variable.

10. The walker of claim 1, wherein the grip is comprised of foam or plastic.

11. The walker of claim 10, wherein the grip is covered by cloth, fabric, leather or other upholstery materials.

12. The walker of claim 1, wherein an additional joint and ratcheting hinge are provided in the adjustable-height load bearing tube at a different point than the first joint and ratcheting hinge.

* * * * *